US011346227B2

(12) United States Patent
Vogel et al.

(10) Patent No.: US 11,346,227 B2
(45) Date of Patent: May 31, 2022

(54) MODULAR COMPONENTS FOR GAS TURBINE ENGINES AND METHODS OF MANUFACTURING THE SAME

(71) Applicant: Power Systems Mfg., LLC, Jupiter, FL (US)

(72) Inventors: Gregory Edwin Vogel, Palm Beach Gardens, FL (US); Thomas Rosenbarger, North Palm Beach, FL (US); Joshua R. McNally, Jupiter, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 304 days.

(21) Appl. No.: 16/721,292

(22) Filed: Dec. 19, 2019

(65) Prior Publication Data

US 2021/0189885 A1 Jun. 24, 2021

(51) Int. Cl.

| | |
|---|---|
| ***F01D 5/14*** | (2006.01) |
| ***F01D 5/28*** | (2006.01) |
| ***F01D 5/18*** | (2006.01) |
| ***F01D 9/06*** | (2006.01) |

(52) U.S. Cl.

CPC ..... *F01D 5/147* (2013.01); *F01D 5/288* (2013.01); *F01D 5/187* (2013.01); *F01D 9/065* (2013.01); *F05D 2230/60* (2013.01); *F05D 2230/90* (2013.01); *F05D 2240/12* (2013.01); *F05D 2240/80* (2013.01); *F05D 2260/20* (2013.01); *F05D 2300/611* (2013.01)

(58) Field of Classification Search

CPC ..... F01D 5/147; F01D 5/288; F01D 5/187; F01D 9/065; F05D 2230/60; F05D 2230/90; F05D 2240/12; F05D 2240/80; F05D 2260/20; F05D 2300/611

See application file for complete search history.

(56) References Cited

U.S. PATENT DOCUMENTS

| | | | | |
|---|---|---|---|---|
| 6,811,373 | B2 * | 11/2004 | Tomita | C23C 28/00 415/173.1 |
| 8,100,653 | B2 * | 1/2012 | Gerakis | F01D 5/147 416/97 R |
| 8,662,849 | B2 * | 3/2014 | Giglio | F01D 5/288 416/193 A |

(Continued)

*Primary Examiner* — Courtney D Heinle
*Assistant Examiner* — Andrew Thanh Bui
(74) *Attorney, Agent, or Firm* — Hovey Williams LLP

(57) ABSTRACT

Modular assemblies for gas turbine engines such as modular vane assemblies and methods of manufacturing the same. The modular assembly includes a first modular component such as a vane platform having a first mating pocket, and a second modular such as an airfoil. The second modular component includes circumferentially extending first and second surfaces at first and second distal ends thereof, respectively, with the first surface being received within the first pocket when the modular assembly is in the assembled state. The second modular component also includes a coating pocket extending from the first surface to the second surface. The coating pocket is recessed towards an interior of the second modular component with respect to first surface and the second surface, and a thermal barrier coating is included within the coating pocket and not included on the first surface or the surface.

15 Claims, 11 Drawing Sheets

(56) References Cited

U.S. PATENT DOCUMENTS

| | | | | |
|---|---|---|---|---|
| 8,915,058 | B2 * | 12/2014 | Knott | F01D 5/18 60/39.093 |
| 10,677,068 | B2 * | 6/2020 | Hansen | F01D 5/282 |
| 2016/0376899 | A1 * | 12/2016 | Prugarewicz | F01D 25/14 415/115 |
| 2017/0145914 | A1 * | 5/2017 | Lineton | C23C 4/06 |

* cited by examiner

MODULAR COMPONENTS FOR GAS TURBINE ENGINES AND METHODS OF MANUFACTURING THE SAME

TECHNICAL FIELD

The present invention generally relates to gas turbine engines. More specifically, aspects of the invention are directed to a modular components used to form heat-resistant assemblies of a gas turbine engine such as a first stage turbine vane assembly.

BACKGROUND OF THE INVENTION

A typical gas turbine engine comprises a compressor, at least one combustor, and a turbine, with the compressor and turbine coupled together through an axial shaft. In operation, air passes through the compressor, where the pressure of the air increases and then passes to a combustion section, where fuel is mixed with the compressed air in one or more combustion chambers and ignited. The hot combustion gases then pass into the turbine and drive the turbine. As the turbine rotates, the compressor turns because the compressor and turbine are coupled together along a common shaft. The turning of the shaft also drives a generator for electrical applications.

The turbine may include various stages of vanes and blades used to extract energy from the hot combustion gasses passing through the turbine and covert the energy into mechanical energy in the form of the rotating turbine shaft. More particularly, the turbine may include alternating stages of stationary vanes and rotating blades. The hot combustion gases increase velocity and/or change flow direction as the gases flow over the stationary vanes, and thereafter flow across the rotating blades creating lift and thus turning the rotor and the turbine shaft coupled thereto.

Because the turbine vanes and blades—particularly the early stage vanes and blades—must withstand high temperatures, they are often coated with a thermal barrier coating to protect the vanes and blades from premature failure. Such coatings increase the complexity of the manufacturing processes used to create such blades and vanes. For example, vane and blade assemblies—which, at a high level, include an inner and outer platform with an airfoil extending therebetween—are manufactured as a single, integral piece and thereafter coated with a thermal barrier coating. This is to avoid spallation or other failure of the thermal barrier coating that may otherwise arise when assembling a vane or blade assembly from multiple component parts. Forming the vane and blade assemblies as a single, integral piece also reduces the risk of spallation or other damage to the thermal barrier coating during thermal expansion and contraction of the vane and blade assemblies when exposed to the hot combustion gases.

However, it would be beneficial to manufacture such assemblies from multiple, component parts. For one, the airfoils and platforms are ultimately exposed to different combustion gas temperatures and operating conditions, with the airfoil typically experiencing the highest temperatures and heat transfer rates from the flow impinging on the airfoil at the leading edge, and the platforms experiencing lower temperatures and heat transfer rates. Thus, it would be desirable to manufacture the component parts of a vane or blade separately and thus tailor the cooling technologies incorporated into each respective component to the operating condition ultimately experienced. Moreover, for assemblies constructed from multiple component parts, during reconditioning only a worn or damaged components needs to be replaced, with all other non-damaged components of the assembly reused.

There thus remains a need for a gas turbine assembly that is comprised of various modular components separately coated with a thermal barrier coating, but for which there is a reduced risk of spallation or other damage to the respective coatings during assembly of the component parts into a vane assembly or the like.

BRIEF SUMMARY OF THE INVENTION

Embodiments of the present invention are directed toward a gas turbine assembly constructed from multiple modular component parts. At a high level the assemblies may include one or more platforms and an airfoil, with the airfoil including a coating pocket configured to receive a thermal barrier coating prior to assembly. The coating pocket may permit assembly of components such as the one or more platforms and the airfoil, each having a thermal barrier coating thereon, into an assembly such as a vane assembly or the like, without the risk of spallation or damage to the respective coatings during assembly.

More particularly, one embodiment of the invention is directed to a modular assembly for a gas turbine engine. The modular assembly may include a first modular component including a first mating pocket, and a second modular component including a first circumferentially extending surface at a first distal end of the second modular component that is received within the first mating pocket, a second circumferentially extending surface at a second, opposing distal end of the second modular component, and a coating pocket extending, in a radial direction, from the first circumferentially extending surface to the second circumferentially extending surface. The coating pocket is recessed towards an interior of the second modular component with respect to first circumferentially extending surface and the second circumferentially extending surface, and a first thermal barrier coating is included within the coating pocket and not included on the first circumferentially extending surface or the second circumferentially extending surface.

Other embodiments of the invention are directed to a modular vane assembly for a gas turbine engine. The vane assembly includes an inner platform including an inner platform pocket, an outer platform including an outer platform pocket, and an airfoil extending between the inner platform and the outer platform. The airfoil includes a circumferentially extending, inner platform mating surface at a first distal end of the airfoil and received within the inner platform pocket, a circumferentially extending, outer platform mating surface at an opposing, second distal end of the airfoil and received within the outer platform pocket, and a coating pocket extending, in a radial direction, from the inner platform mating surface to the outer platform mating surface, the coating pocket being recessed towards an interior of the airfoil with respect to inner platform mating surface and the outer platform mating surface. A first thermal barrier coating is included within the coating pocket and not included on the inner platform mating surface or the outer platform mating surface.

Still other embodiments of the invention are directed to a method of constructing a modular vane assembly for a gas turbine engine. The method includes manufacturing an airfoil, with the airfoil including a circumferentially extending, first platform mating surface at a first distal end of the airfoil, a circumferentially extending, second platform mating surface at an opposing, second distal end of the airfoil, and a coating pocket extending, in a radial direction, from the first platform mating surface to the second platform mating surface, the coating pocket being recessed towards an interior of the airfoil with respect to first platform mating surface and the second platform mating surface. The method also includes coating the airfoil with a first thermal barrier coating including applying the first thermal barrier coating within the coating pocket and not on the first platform mating surface or the second platform mating surface. The method additionally includes manufacturing a platform that includes a platform surface and a platform pocket recessed from the platform surface and coating the platform with a second thermal barrier including applying the second thermal barrier coating to the platform surface and not to the platform pocket. Finally, the method includes assembling the modular vane assembly by inserting the first platform mating surface into the platform pocket and fastening the airfoil in place.

Additional advantages and features of the present invention will be set forth in part in a description which follows, and in part will become apparent to those skilled in the art upon examination of the following or may be learned from practice of the invention.

BRIEF DESCRIPTION OF THE DRAWINGS

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
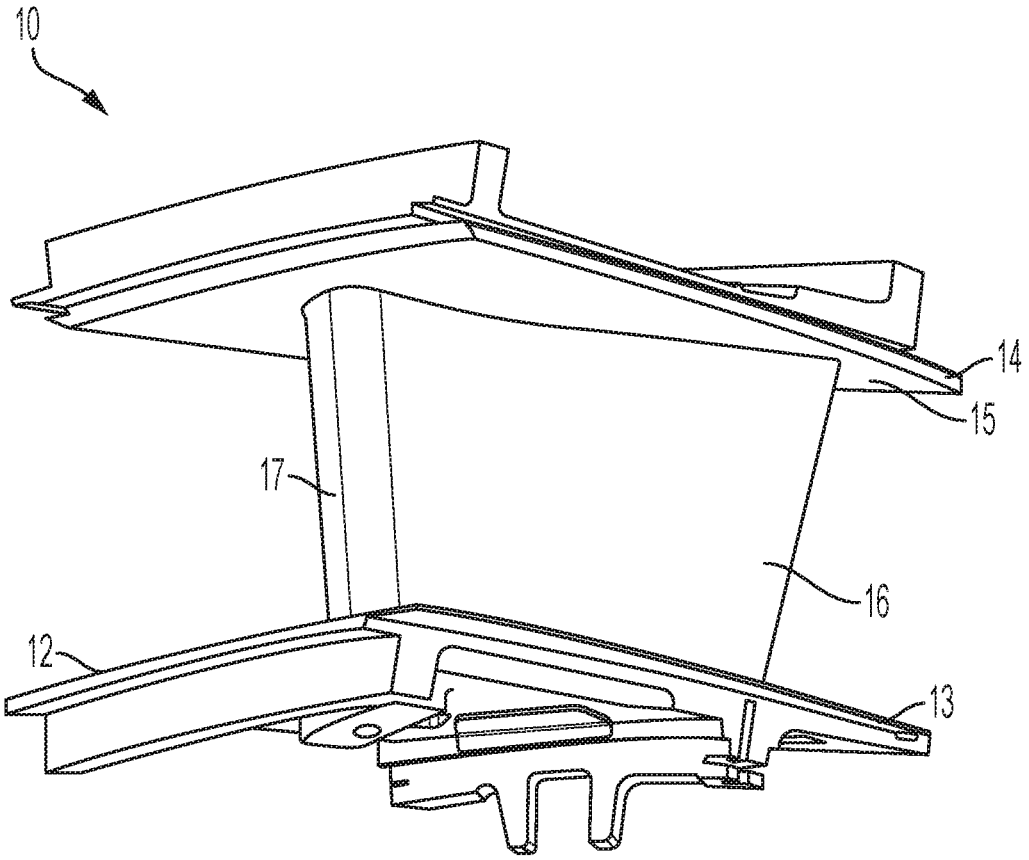
FIG. 1 is a perspective view of a turbine vane assembly according to one embodiment of the invention.
Figure 2:
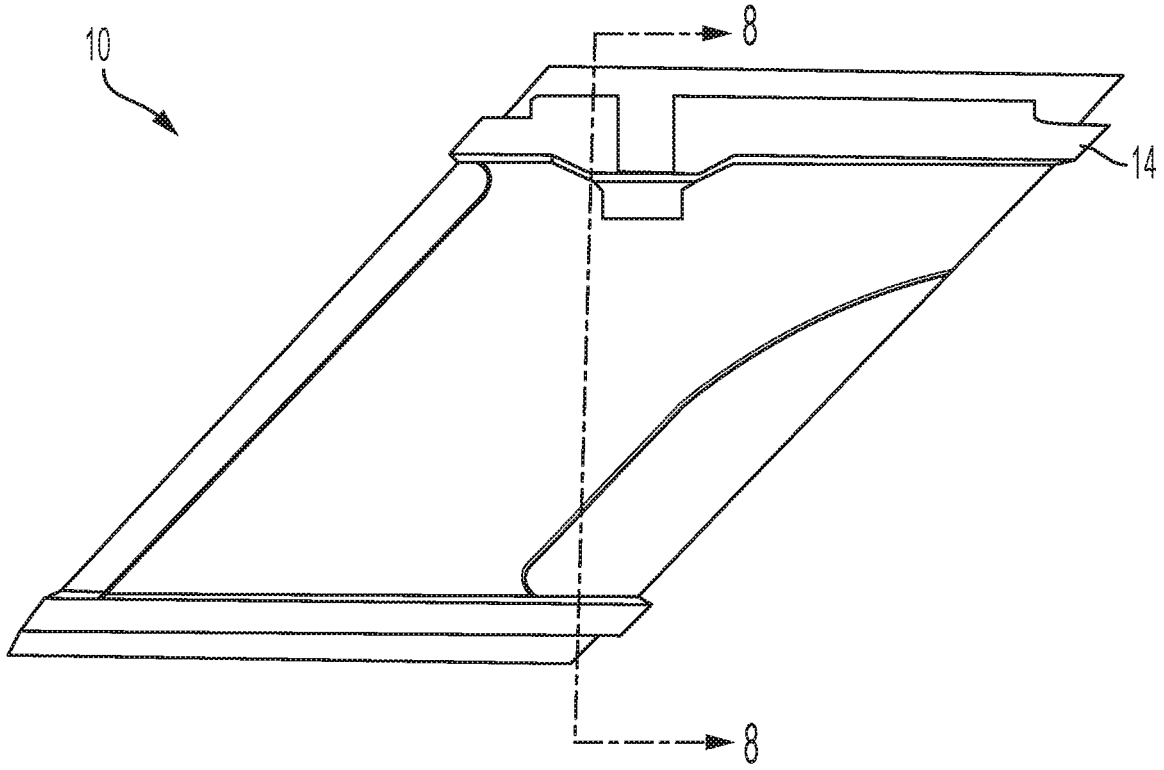
FIG. 2 is a top, plan view of the turbine vane assembly shown in FIG. 1.

FIGS. 1 and 2 show a vane assembly 10 of a gas turbine engine according to aspects of the invention. Although the assembly will be referred to as a vane assembly 10 herein for ease of discussion, this is not intended to limit the invention to stationary vanes of a turbine. Instead, aspects of the invention may be employed on turbine blades, other airfoils within a gas turbine engine, or any other modular assembly comprised of one or more coated components.

The vane assembly 10 generally includes an inner platform 12, an outer platform 14, and an airfoil 16 extending, in a radial direction, between the inner platform 12 and outer platform 14. The inner platform includes a radially outwardly facing surface 13 and the outer platform includes a radially inwardly facing surface 15, and a working surface 17 of the airfoil 16 extends, in the radial direction, between the radially outwardly facing surface 13 and the radially inwardly facing surface 15. In this regard, in embodiments in which the vane assembly 10 forms part of the turbine of a gas turbine engine, hot combustion gasses exiting the combustor will flow across the radially outwardly facing surface 13, the radially inwardly facing surface 15, and the working surface 17. As will be discussed in more detail, often such surfaces thus include a thermal barrier coating to protect the vane assembly 10 from premature failure of the like due to continued exposure to the hot combustion gases.

In some embodiments, a plurality of substantially identical vane assemblies 10 may be combined to form a stage of a turbine of a gas turbine engine. More particularly, in such embodiments a plurality of the vane assemblies 10 shown in FIG. 1 are operatively connected to form a radial array of vane airfoils. For example, in some embodiments the vane assembly 10 may form a portion of a first stage of turbine, and the airfoil 16 is thus a first stage turbine vane. In such embodiments, the airfoil 16 will form part of the first airfoils encountered by the hot combustion gasses leaving the combustor of the gas turbine engine. More particularly, during use hot combustion gasses leaving the combustor flow over the working surface 17 of the airfoil 16, which increases the velocity of the hot combustion gasses. The combustion gasses are then directed over the first stage turbine blades, which spin and turn an axial shaft of the gas turbine engine, thus extracting energy from the hot gasses. The hot combustion gasses continue in the axial direction to the second, third, fourth, etc., stages of vanes and blades in the turbine.

According to aspects of the invention, the vane assembly 10 is comprised of modular, coated components separately manufactured and then combined to form the assembly 10. In some embodiments, each of the inner platform 12, the outer platform 14, and the airfoil 16 are formed as a modular component that in turn is operatively assembled to form the vane assembly 10. In such embodiments the modular components 12, 14, and 16 may be operatively connected using any desired fastening technique. For example, in some embodiments the inner platform 12, outer platform 14, and airfoil 16 are manufactured as separate modular components and then assembled into the vane assembly 10 and held together by a plurality threaded fasteners or the like, such as a plurality of radially extending bolts and corresponding nuts. In other embodiments the inner platform 12, outer platform 14, and airfoil 16 are manufactured as separate modular components and then assembled into the vane assembly 10 and held together by welding, brazing, or other mechanical joining process without departing from the scope of the invention.

Figure 3:
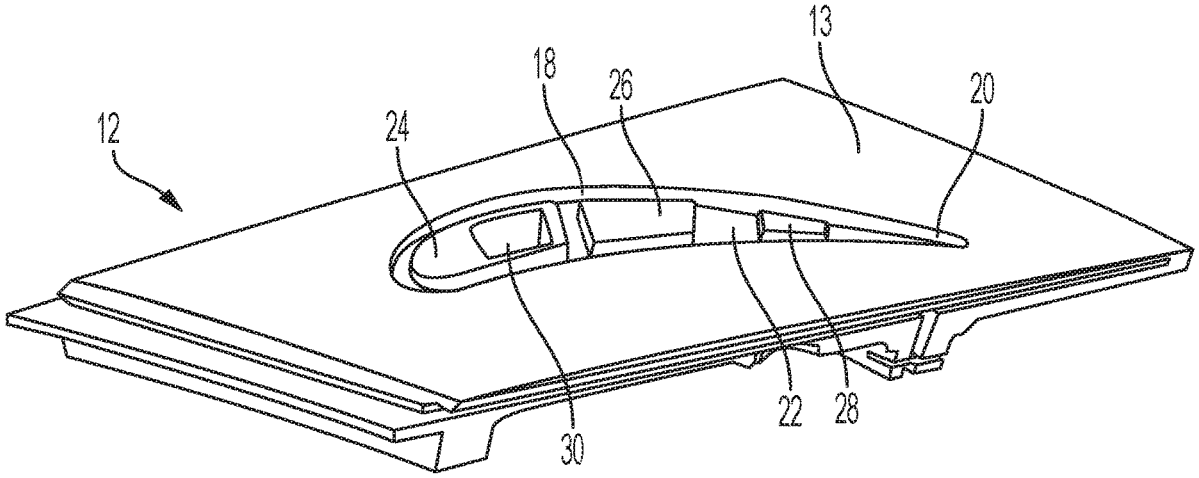
FIG. 3 is a perspective view of an inner platform of the turbine vane assembly shown in FIGS. 1-2.

FIGS. 3-6 show in detail the three separate modular components—the inner platform 12, the outer platform 14, and the airfoil 16—that may be combined to, at least in part, form the vane assembly 10 shown in FIGS. 1 and 2. First, FIG. 3 shows the inner platform 12 according to aspects of the invention. The inner platform 12 generally includes an inner platform pocket 18 formed in the radially outwardly facing surface 13 of the inner platform 12 and configured to receive a first, inner end 44 of the airfoil 16. The inner platform pocket 18 generally includes a first boundary wall 20 defining, at least in part, a recessed portion 22 that is shaped and sized to receive the first end 44 of the airfoil 16. In some embodiments, the inner platform pocket 18 also includes a plurality of protrusions. More particularly, in the depicted embodiment the inner platform pocket 18 includes a first protrusion 24, a second protrusion 26, and a third protrusion 28. Each protrusion is sized and shaped to be received within a corresponding interior channel of the airfoil 16 when the vane assembly 10 is assembled, as will be discussed in more detail. In some embodiments, the inner platform pocket 18 may also include one or more cooling air inlets, such as first cooling air inlet 30. During use, the first cooling air inlet 30 provides fluid communication between a cooling air reservoir and an interior of the airfoil 16, which will be discussed in more detail below.

Figure 4:
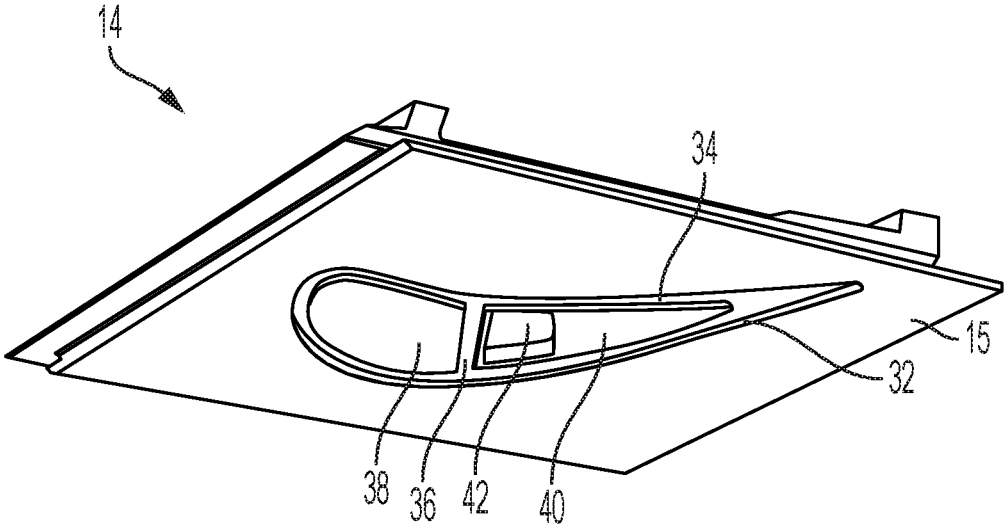
FIG. 4 is a perspective view of an outer platform and the turbine vane assembly shown in FIGS. 1-2.

Turning now to FIG. 4, the outer platform 14 includes a similarly sized and shaped pocket 32 as the inner platform pocket 18, the outer platform pocket 32 being configured to receive a second, outer end 46 of the airfoil 16 when the modular components are in the assembled state forming the vane assembly 10 shown in FIGS. 1 and 2. More particularly, the outer platform pocket 32 is formed in the radially inwardly facing surface 15 of the outer platform 14 and generally includes a second boundary wall 34 defining, at least in part, a second recessed portion 36 that is shaped and sized to receive the second end 46 of the airfoil 16. In some embodiments, the outer platform pocket 32 also includes a plurality of protrusions. More particularly, in the depicted embodiment the inner platform pocket 18 includes a fourth protrusion 38 and a fifth protrusion 40. As with the protrusions 24, 26, and 28 of the inner platform pocket 18, each protrusion 38, 40 is sized and shaped to be received within a corresponding interior channel of the airfoil 16 when the vane assembly 10 is assembled. In some embodiments, the outer platform pocket 32 may also include one or more cooling air inlets, such as second cooling air inlet 42. During use, the second cooling air inlet 42 provides fluid communication between a cooling air reservoir and an interior of the airfoil 16, which will be discussed in more detail below.

Figure 5:
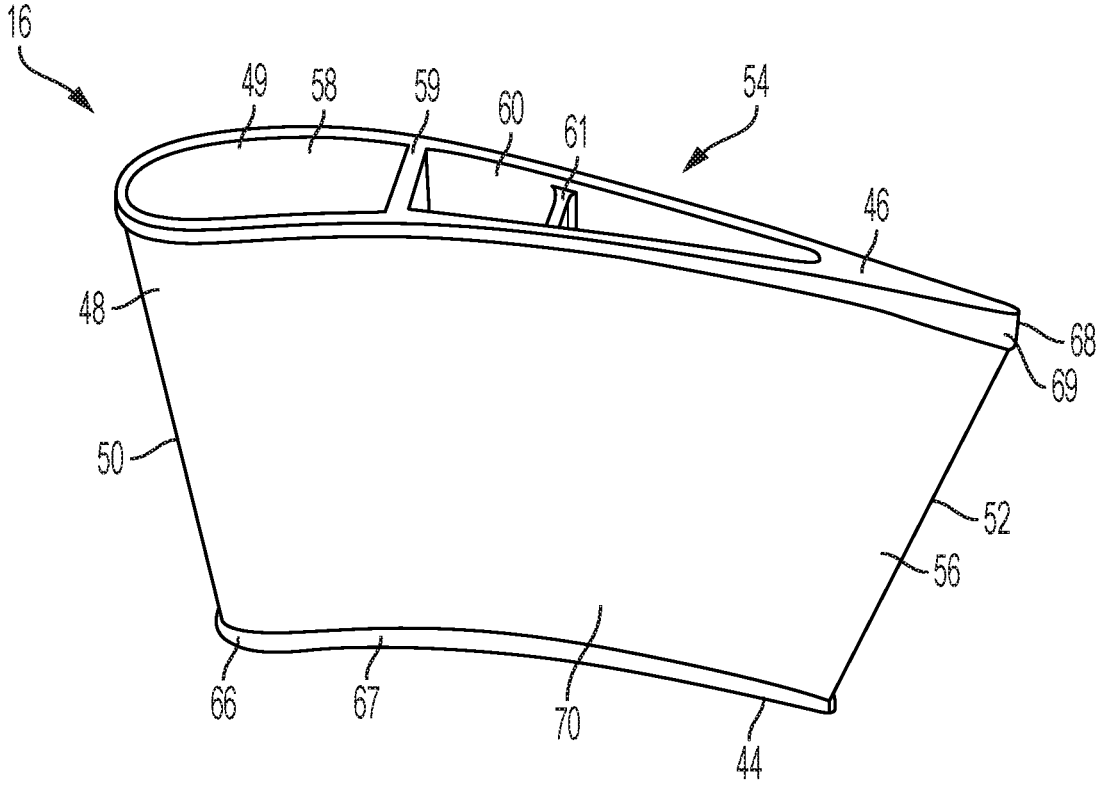
FIG. 5 is a perspective view of an airfoil of the turbine vane assembly shown in FIGS. 1-2.
Figure 6:
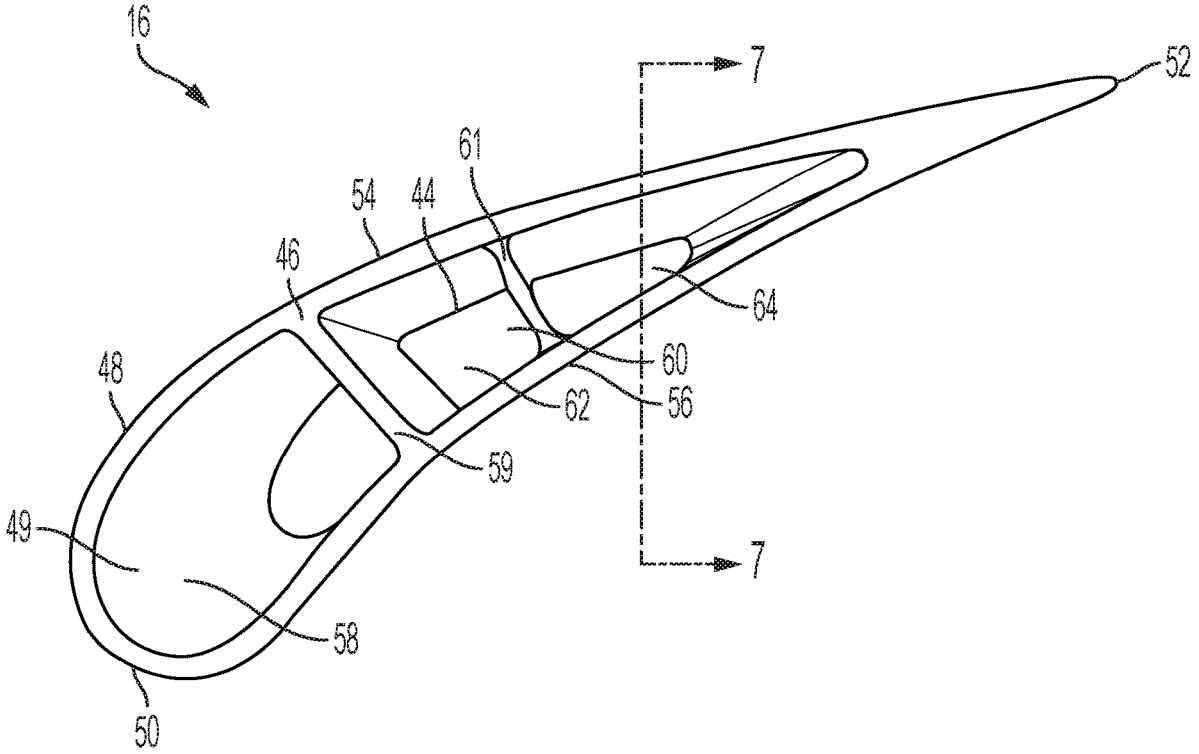
FIG. 6 is a top, plan view of the airfoil shown in FIG. 5.

FIGS. 5 and 6 show the airfoil 16, which is a third modular component forming the vane assembly 10. The airfoil 16 generally extends in a radial direction from a first end 44 to a second end 46, and in a substantially axial direction from a leading edge 50 to a trailing edge 52. The outermost walls of the airfoil 16 are generally defined by an outer surface 48 and an inner surface 49. In cross-section, the outer surface 48 generally follows the contour of the inner platform pocket 18 and the outer platform pocket 32 (but for the recessed coating pocket 70, which will be described in detail) and, in that regard, includes concave and convex portions that result in a suction side 54 and a pressure side 56. More particularly, the flow of hot combustion gases or the like over the suction side 54 of the airfoil 16 results in a negative pressure acting on the airfoil 16, while the flow of hot combustion gases or the like over the pressure side 56 of the airfoil 16 results in a positive pressure acting on the airfoil 16.

The inner surface 49 and inner walls 59, 61 of the airfoil 16 at least in part defines the various interior chambers 58, 60, 62, and 64, the outer contours of which correspond to the protrusions 24/38, 40, 24, 26, and 28, respectively. In some embodiments, the first chamber 58 extends the radial extent of the airfoil 16 and is isolated (that is, not in fluid communication with) the other chambers by the first inner wall 59. The second chamber 60 extends radially downward from the second end 46 and splits into the third chamber 62 and the fourth chamber 64 via the second inner wall 61. In that regard, the second, third, and fourth chambers 60, 62, 64 are in fluid communication with one another. During use, cooling air is provided to the first chamber 58 via the first cooling air inlet 30 and to the second, third, and fourth chambers 60, 62, and 64 via the second cooling air inlet 42. The cooling air may circulate throughout the chambers 58, 60, 62, and 64 providing heat transfer benefits, and in some embodiments may be provided to the outer surface 48 of the airfoil via a series of cooling holes (not shown) fluidly connecting the inner chambers 58, 60, 62, and 64 to the ambient air around the airfoil 16.

As best seen in FIG. 5, according to some aspects of the invention, the airfoil 16—and more particularly, the outer surface 48 of the airfoil 16—includes a circumferentially extending coating pocket 70 extending a majority of the radial length of the airfoil 16. The coating pocket 70 advantageously provides a location on the airfoil 16 for receiving a thermal barrier coating without interfering with the fit between the various modular components 12, 14, and 16 when in the assembled state. Beneficially, the separately manufactured components can each receive a thermal barrier coating, in some embodiments with varying thicknesses from part to part, yet still be ultimately assembled into the vane assembly 10 or the like without the risk of spallation of the coating during assembly.

In some embodiments, the outer surface 48 of the airfoil 16 generally includes a circumferentially extending, inner platform mating portion 66 proximate the first end 44 and an a circumferentially extending, outer platform mating portion 68 proximate the second end 46, with the coating pocket 70 extending, in a radial direction, between the inner platform mating portion 66 and the outer platform mating portion 68. At a high level, a circumferentially outwardly facing surface 67 of the inner platform mating portion 66 generally follows the contour of the first boundary wall 20 of the inner platform pocket 18 and is sized to fit within the inner pocket 18 during assembly. That is, the circumferentially outwardly facing surface 67 of the inner platform mating portion 66 has substantially the same general contour as the first boundary wall 20 of the inner platform pocket 18 but is slightly smaller such that the inner platform mating portion 66 is received within the inner platform pocket 18 in a clearance fit during assembly. Similarly, a circumferentially outwardly facing surface 69 of the outer platform mating portion 68 generally follows the contour of the second boundary wall 34 of the outer platform pocket 32 and is sized to fit within the outer platform pocket 32 during assembly. That is, the circumferentially outwardly facing surface 69 of the outer platform mating portion 68 has substantially the same general contour as the second boundary wall 34 of the outer platform pocket 32 but is slightly smaller such that the outer platform mating portion 68 is received within the outer platform pocket 32 in a clearance fit during assembly. The coating pocket 70, in turn, is recessed inwardly (that is, towards an interior of the airfoil 16) from each of the circumferentially outwardly facing surfaces 67,69.

Figure 7:
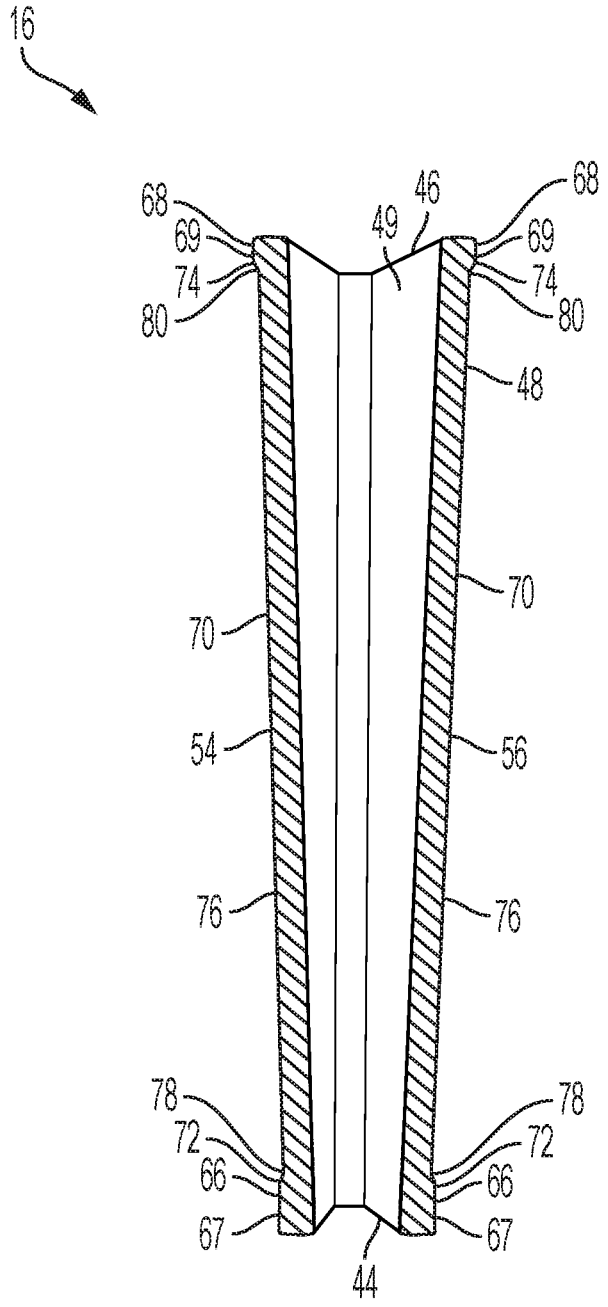
FIG. 7 is a cross-sectional view of the airfoil shown in FIGS. 5-6 as viewed along line 7-7 in FIG. 6.
Figure 8:
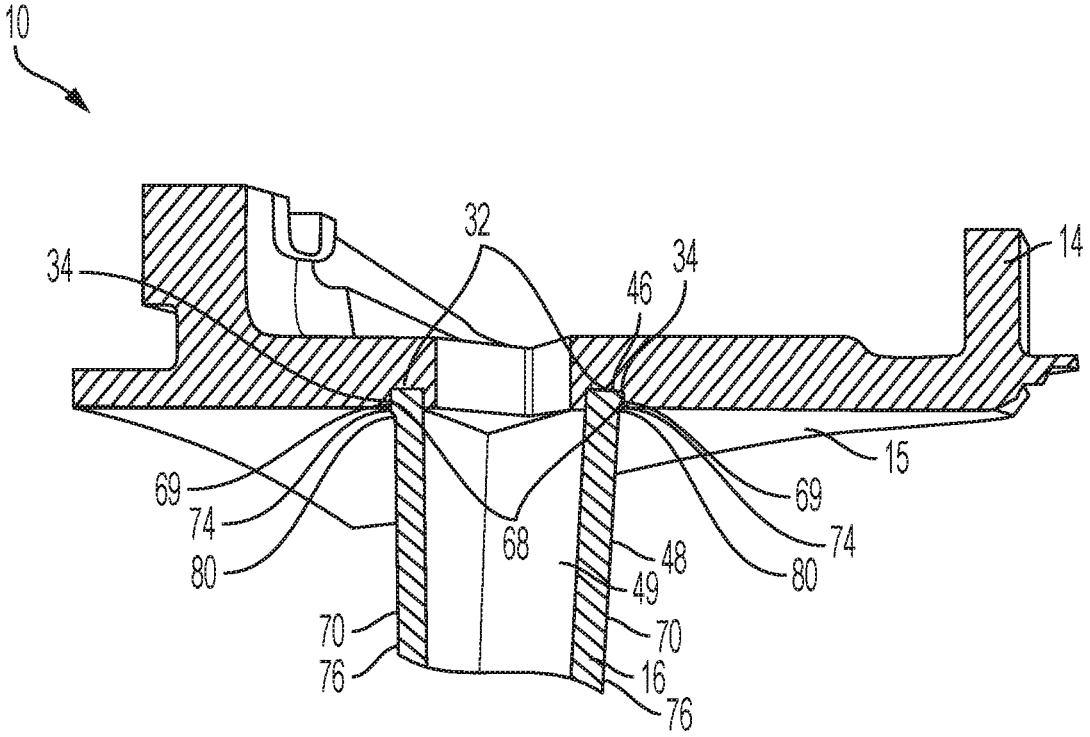
FIG. 8 is a fragmentary, cross-sectional view of the turbine vane assembly shown in FIGS. 1-2 as viewed along line 8-8 in FIG. 2.
Figure 9:
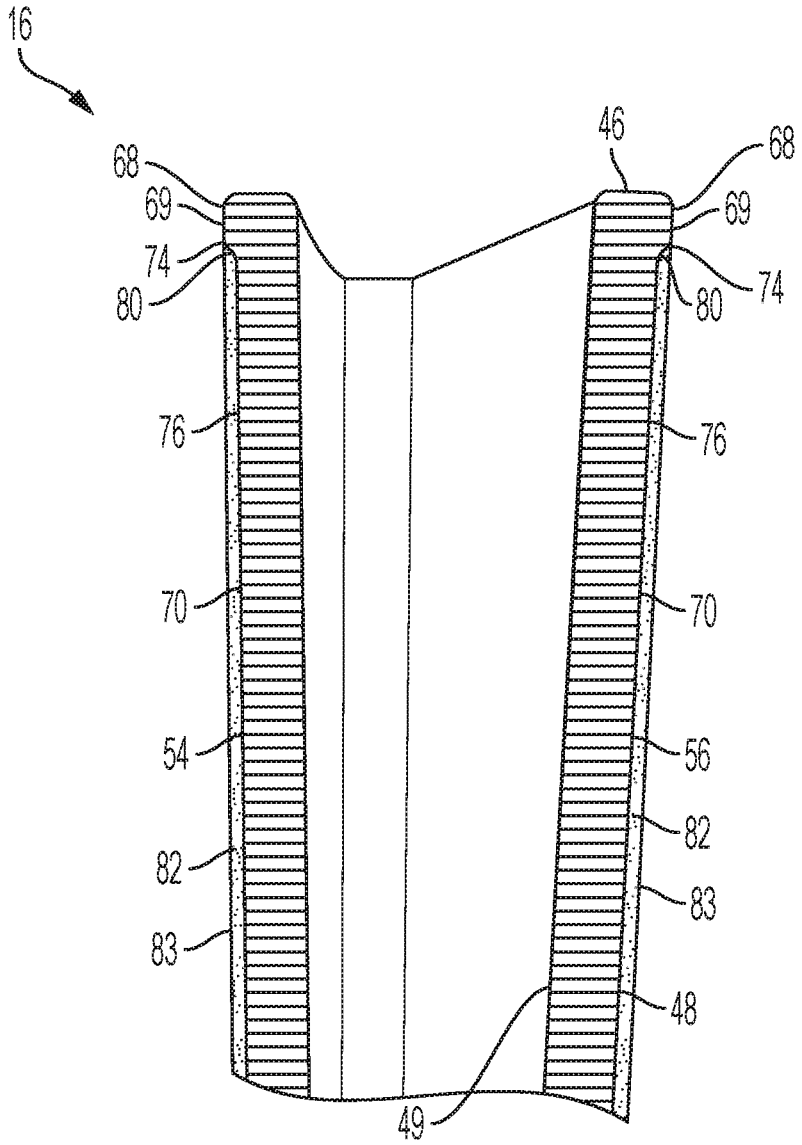
FIG. 9 is a fragmentary, cross-sectional view of the airfoil shown in FIGS. 5-7 as viewed along line 7-7 in FIG. 6 and showing a thermal barrier coating applied to a pocket thereof.

The coating pocket 70 extends, in a radial direction, from a first edge 72 abutting the inner platform mating portion 66 to a second edge 74 abutting the outer platform mating portion 68. Moreover, the coating pocket 70 generally includes a pocket surface 76 extending circumferentially around the airfoil 16 and extending the majority of the radial length of the airfoil 16, a first transition surface 78 extending from the pocket surface 76 to the first edge 72, and a second transition surface 80 extending from the pocket surface 76 to the second edge 74. In the depicted embodiment, and as best seen in FIGS. 7-9, the transition surfaces 78, 80 are filleted surfaces that smoothly connect the radially extending pocket surface 76 to the first and second edges 72, 74, respectively. However, other cross-sectional contours could be implemented without departing from the scope of the invention. For example, in some embodiments the transition surfaces 78, 80 may be chamfered surfaces linearly connecting the pocket surface 76 to the first and second edges 72, 74, respectively.

The coating pocket 70—and more particularly the pocket surface 76, first transition surface 78, and second transition surface 80—define a recessed region in which a thermal barrier coating is applied such that the coating will not be vulnerable to spallation or other failure during an assembly of the modular components 12, 14, and 16 into the vane assembly 10. In some embodiments, the coating pocket 70 and the surfaces thereof 76, 78, and 80, are sized and configured to receive the thermal barrier coating such that the outermost portion thereof in the circumferential direction (i.e., the portion encountering the hot combustion gases or the like during operation) is substantially flush with the circumferentially outwardly facing surfaces 67, 69 of the inner and out pocket mating portions 66, 68, respectively.

Figure 10:
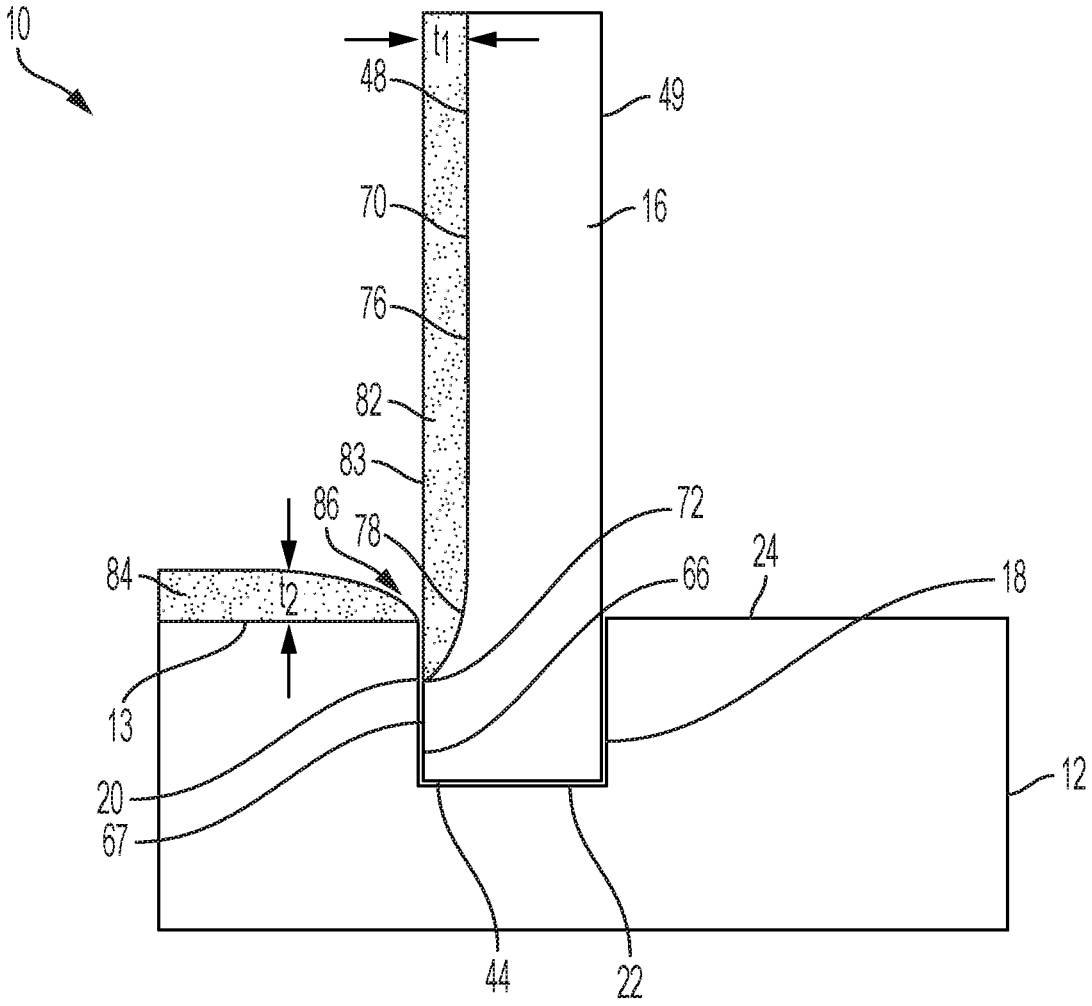
FIG. 10 is a schematic view representing a thermal barrier coating applied to a pocket of the airfoil and a surface of the inner platform according to aspects of the invention.

This may be best understood with reference to FIGS. 9-10, which show various coatings applied to the modular components 12, 14, and 16, of the vane assembly 10 including an airfoil coating 82 being received within the coating pocket 70. In some embodiments, a thermal barrier coating is applied to the gas path surfaces of the modular components 12, 14, and 16 (e.g., the radially outwardly facing surface of the inner platform 13, the radially inwardly facing surface of outer platform 15, and the coating pocket 70 of the airfoil 16) prior to assembly of the modular components into the vane assembly 10. More particularly, in some embodiments each modular component 12, 14, and 16 may be manufactured (e.g., cast, molded, additively manufactured, etc.) separate from one another, coated with a suitable thermal barrier coating, and then assembled into the vane assembly 10.

More particularly, FIGS. 9 and 10 show fragmentary, cross-sectional views of the airfoil 16 near the second and first ends 46, 44 thereof, respectively, and including an airfoil coating 82 applied to the coating pocket 70. The airfoil coating 82 extends, in the radial direction, between the first edge 72 and the second edge 74 of the coating pocket 70 and is received within the recessed pocket 70 such that a circumferentially outwardly facing surface 83 of the airfoil coating 82 is substantially flush with the circumferentially outwardly facing surfaces 67, 69 of the inner and out platform mating portions 66, 68, respectively. Put another way, the airfoil coating 82 substantially occupies the recess formed by the coating pocket 70 such that the outer contour of the airfoil 16, once coated, no longer includes a recessed portion.

As best seen in FIG. 10, which schematically represents a close-up, cross-sectional view of a portion of a coated airfoil 16 received within the inner platform pocket 18, the coating pocket 70 reduces the risk of spallation and other damage to coatings during assembly of the modular components because the coatings do not bear on one another and/or other modular parts during assembly. More particularly, if the airfoil 16 did not include the pocket 70, the coating 82 applied the airfoil would extend outwardly from the circumferentially outwardly facing surface 67 of the inner platform mating portion 66 and thus the coating 82 would bear against the first boundary wall 20 of the inner platform pocket 18 and/or an inner platform coating 84 applied to the radially outwardly facing surface 13 of the inner platform 12. This may lead to spallation or other failure of the airfoil coating 82 and/or the inner platform coating 84. However, due to the presence of the coating pocket 70, the airfoil coating 82 is flush with (or, in some embodiments, slightly recessed from) the circumferentially outwardly facing surface 67 of the inner platform mating portion 66. This in turn creates a working clearance at the mating portion 86 where the airfoil coating 82 meets the first boundary wall 20 of the inner platform pocket 18 and/or the inner platform coating 84. The result is that during assembly of the vane assembly 10 or other similar assembly within a gas turbine engine, the integrity of the respective coatings 82, 84 is maintained as the modular components 12, 14, and 16 are welded, braised, bolted, or otherwise fastened together.

Still more, the coating pocket 70 enables the modular components 12, 14, and 16 to thermally expand and contract during use without the risk of spallation or other failure of the respective coatings. Namely, if the coating pocket 70 was not included on airfoil 16, the coatings of the modular components 12, 14, and 16 may interfere with one another and/or the other modular components 12, 14, and 16 during thermal expansion and contraction during engine operation, resulting in spallation or other damage. Because embodiments of the invention including the coating pocket 70 include, for example, a clearance at the mating portion 86 of two coated surfaces, the components expand and contract during use without risk of spallation and premature damage.

Advantageously, manufacturing the vane assembly 10 or the like from modular components such as the inner platform 12, the outer platform 14, and the airfoil 16 provides a flexibility in manufacturing techniques that can be employed to create gas turbine components and permits different thicknesses of coatings to be applied to different gas-interaction surfaces. For example, due to the limitations in applying thermal barrier coatings to vane assemblies formed by modular components, vane assemblies are traditionally manufactured as a single piece using an additive manufacturing process or else cast as a single piece using complex molds, dies, and other tooling. By manufacturing the vane assembly 10 piecemeal according to aspects of the invention—that is, by manufacturing each modular component 12, 14, and 16 separately and then later assembling the components into the vane assembly 10—less complex tooling and/or manufacturing processes can be employed because the geometry of each modular component 12, 14, and 16 is much simpler than the assembly as a whole. Additionally, manufacturing the components 12, 14, and 16 separately provides more options for, e.g., adding cooling holes to the components, as holes can be drilled, cast, printed, or otherwise included on portions of the vane assembly 10 that would not be possible if the vane assembly 10 were manufactured as a single component. The modular design also provides benefits from a reconditioning standpoint, as the components can be replaced separately from one another.

Moreover, applying the thermal barrier coating may be quicker and easier for each component part rather than the assembly as a whole. And varying thicknesses of the thermal barrier coating may easily be applied to different surfaces prior to assembly. When a vane assembly is manufactured as a single component, a thickness of the thermal barrier coating applied to each gas-interaction surface is substantially the same because the thermal barrier coating is applied to each surface at the same time and using the same process. However, because according to aspects of the invention the vane assembly 10 is comprised of modular components 12, 14, and 16 that are later assembled to form the vane assembly 10, each modular component 12, 14, and 16 can be coated separately and thus a thickness of the coating may be varied according to application.

More particularly, during use turbine vane airfoils (such as airfoil 16) are exposed to different gas temperature levels than turbine vane platforms (such as inner platform 12 and outer platform 14). The airfoil 16 typically is exposed to the highest temperature gases and heat transfer rates due to the flow impinging on the airfoil 16 at the leading edge 50, while the platforms 14, 16 typically are exposed to lower temperatures and heat transfer rates. Thus, according to aspects of the invention, the airfoil 16 is designed with better cooling technologies than the platforms 12, 14. In some embodiments, the thickness of the thermal barrier coating applied to the airfoil 16 is thus greater than the thickness of the coating applied to the platforms 12, 14. More particularly, an average thickness of thermal barrier coating applied to the airfoil may be greater than an average thickness of the thermal barrier coating applied to the radially outwardly facing surface 13 of the inner platform 12 and/or the radially inwardly facing surface 15 of the outer platform 14.

In other embodiments, due to the higher temperatures to be faced by the airfoil 16, the airfoil 16 may include more cooling holes, channels, and other cooling technologies than either platform 12, 14, and thus a thickness of the thermal barrier coating applied to the airfoil 16 may be less than a thickness of the coating applied to the inner platform 12 and/or the outer platform 14. More particularly, an average thickness of thermal barrier coating applied to the airfoil 16 may be less than an average thickness of the thermal barrier coating applied to the radially outwardly facing surface 13 of the inner platform 12 and/or the radially inwardly facing surface 15 of the outer platform 14. More generally, when the vane assembly 10 is formed from the modular components 12, 14, and 16, the airfoil 16 may include a thermal barrier coating having a first average thickness, the inner platform 12 may include a thermal barrier coating having a second average thickness, and the outer platform 14 may include a thermal barrier coating having a third average thickness, wherein the first average thickness may be different from the second average thickness or the third average thickness, and wherein the second average thickness may be different from the third average thickness.

Figure 11:
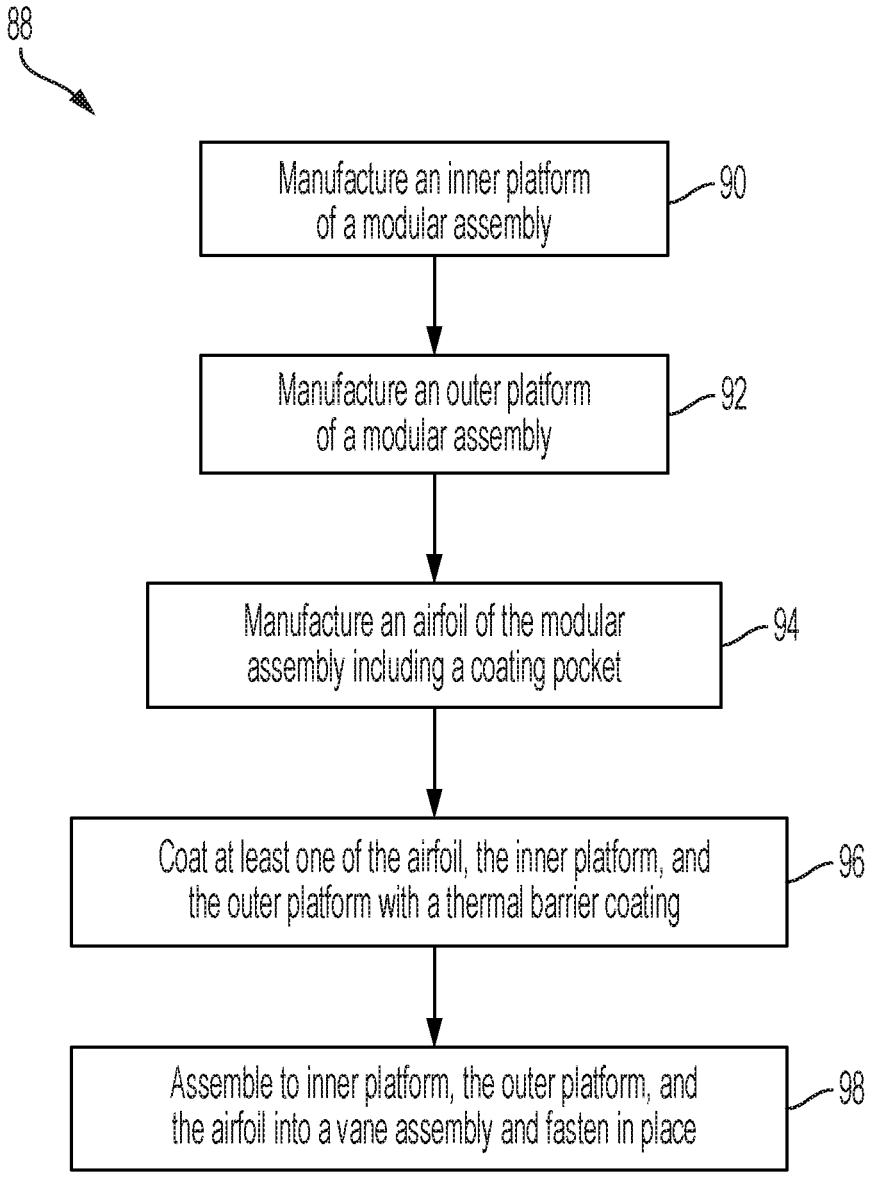
FIG. 11 is a flowchart schematically representing a process for manufacturing a vane turbine assembly using modular, coated components according to some aspects of the invention.

FIG. 11 is a flowchart schematically depicting a method 88 of fabricating an assembly used in a gas turbine engine such as the vane assembly 10 discussed in detail herein or another similar assembly. At step 90, a first modular component is manufactured such as, e.g., the inner platform 12 of the vane assembly 10. The modular component can be formed using any desired manufacturing process such as, e.g., additive manufacturing, casting, machining, or other process. Optionally, the manufacturing may include constructing various channels, protrusions, pockets, and other features within the first modular component that are configured to receive or otherwise interface with various channels, protrusions, pockets, and other features of other modular components during assembly. For example, when the first modular component is the inner platform 12, step 90 may include forming one or more of the inner platform pocket 18, protrusions 24, 26, and 28, and cooling air inlet 30 into the inner platform 12. Moreover, for a first modular component that includes one more cooling holes (not shown), the cooling holes may be drilled and/or integrally manufactured into the first modular component at step 90.

At step 92, a second modular component is manufactured such as, e.g., the outer platform 14 of the vane assembly 10. Again, the modular component can be formed using any desired manufacturing process such as, e.g., additive manufacturing, casting, machining, or other process. Optionally, the manufacturing may include constructing various channels, protrusions, pockets, and other features within the second modular component that are configured to receive or otherwise interface with various channels, protrusions, pockets, and other features of other modular components during assembly. For example, when the second modular component is the outer platform 14, step 92 may include forming one or more of the outer platform pocket 32, protrusions 38 and 40, and cooling air inlet 42 into the outer platform 14. Moreover, for a second modular component that includes one more cooling holes (not shown), the cooling holes may be drilled and/or integrally manufactured into the second modular component at step 92.

At step 94, a third modular component is manufactured such as, e.g., the airfoil 16 of the vane assembly 10. Again, the modular component can be formed using any desired manufacturing process such as, e.g., additive manufacturing, casting, machining, or other process. Optionally, the manufacturing may include constructing various channels, protrusions, pockets, and other features within the third modular component that are configured to receive or otherwise interface with various channels, protrusions, pockets, and other features of other modular components during assembly. For example, when the third modular component is the airfoil 16, step 94 may include forming one or more of the inner platform mating portion 66, the outer platform mating portion 68, the chambers 58, 60, 62, and 64, and the inner walls 59 and 61. Moreover, for a third modular component that includes one more cooling holes (not shown), the cooling holes may be drilled and/or integrally manufactured into the third modular component at step 94.

Moreover, when the third modular component is an airfoil including a coating pocket such as the airfoil 16 including the coating pocket 70, the pocket may be formed in the airfoil 16 at step 94. The coating pocket 70 may be formed using any desired manufacturing process. For example, in embodiments in which the airfoil 16 is created using additive manufacturing, a CAD or other model of the airfoil 16 used during the additive manufacturing process may include the coating pocket 70 and thus the pocket 70 may be integrally formed in the outer surface 48 of the airfoil 16 during the additive manufacturing process. In other embodiments, when the airfoil 16 is cast, one or more molds may include a mirror-image protrusion that thus forms the coating pocket 70 during the casting process. In still other embodiments, the airfoil 16 may be manufactured with no pocket—that is, the outer profile of the initially manufactured airfoil may include no recessed portion between the inner platform mating portion 66 and the outer platform mating portion 68—and the coating pocket 70 may thus thereafter by formed using any desired machining, etching, or other material-removal process. For example, in some embodiments the coating pocket 70 may be formed by using a lathe, laser, or other machine to mechanically remove portions of the airfoil to form the recessed pocket 70 radially between the inner platform mating portion 66 and the outer platform mating portion 68. Any other desired process for forming the coating pocket 70 in the airfoil 16 may be employed at step 94 without departing from the scope of the invention.

At step 96, at least one of the modular component parts is coated with a thermal barrier coating. For example, in embodiments in which the third modular component manufactured at step 94 is an airfoil 16, the airfoil coating 82 may be applied to the airfoil 16 at step 96 such that a circumferentially outwardly facing surface 83 of coating 82 is substantially flush or else slightly recessed from the circumferentially outwardly facing surface 67 of the inner mating platform portion 66 and/or the circumferentially outwardly facing surface 69 of the outer mating platform portion 68. Moreover, when the first and second modular components are the inner platform 12 and the outer platform 14, one or more gas-interacting surfaces of the platforms 12, 14 may be coated with a thermal barrier coating at step 96. For example, the radially outwardly facing surface 13 of the inner platform 12 and/or the radially inwardly facing surface 15 of the outer platform 14 may be coated at step 96.

In some embodiments, the modular components may be coated with a thermal coating barrier having a substantially constant thickness that tapers towards the edge of the surface being coated. For example, with respect to the airfoil 16, the coating pocket 70 may receive the airfoil coating 82, which has a substantially constant thickness (t1) that tapers near the first edge 72 and the second edge 74 due to the presence of the first transition surface 78 and the second transition surface 80, respectively. With respect to the radially outwardly facing surface 13 of the inner platform 12, the inner platform coating 84 may have a substantially constant thickness (t2) that tapers near the first boundary wall 20 of the inner platform pocket, as best seen in FIG. 10. And with respect to the radially inwardly facing surface 15 of the outer platform 14, an outer platform coating (not shown) may have a substantially constant thickness (t3) that tapers near the second boundary wall 34 of the outer platform pocket 32. At step 96 the thermal barrier coatings may be applied to each modular component with varying respective average thicknesses such that t1 is not equal to t2 and/or t3, and/or such that t2 is not equal to t3.

At step 98 the modular components are assembled into the assembly. Again, this may include mating various channels, protrusions, pockets, and other features of one of the modular component parts with various channels, protrusions, pockets, and other features of other modular component parts and securing the component parts in place using any desired process such as, e.g., welding, brazing, securing with a threaded fastener, or other joining process. For example, when the modular components are the inner platform 12, the outer platform 14, and the airfoil 16, the vane assembly 10 may be formed by placing the inner platform mating portion 66 of the airfoil 16 into the inner platform pocket 18 formed within the inner platform 12, placing the outer platform mating portion 68 in the outer platform pocket 32 formed within the outer platform 14, and securing the modular components 12, 14, and 16 in place by welding, brazing, fastening with a threaded fastener or the like, or any other suitable fastening process. Using such a process, the resulting assembly (such as the vane assembly 10 or the like) may include suitably and variably coated gas-interaction surfaces without the risk of spallation or other failure of the thermal barrier coatings during construction.

The present invention has been described in relation to particular embodiments, which are intended in all respects to be illustrative rather than restrictive. Alternative embodiments will become apparent to those of ordinary skill in the art to which the present invention pertains without departing from its scope. From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A modular assembly for a gas turbine engine, the modular assembly comprising:

a first modular component including a first mating pocket and a radially outwardly facing surface, wherein at least part of the first mating pocket is recessed, in the radial direction, from the radially outwardly facing surface;

a second modular component including:

a first circumferentially extending surface at a first distal end of the second modular component and received within the first mating pocket;

a second circumferentially extending surface at a second, opposing distal end of the second modular component; a coating pocket extending, in a radial direction, from the first circumferentially extending surface to the second circumferentially extending surface, the coating pocket being recessed towards an interior of the second modular component with respect to first circumferentially extending surface and the second circumferentially extending surface; and a first thermal barrier coating included within the coating pocket and not included on the first circumferentially extending surface or the second circumferentially extending surface, and a second thermal barrier coating applied to the radially outwardly facing surface of the first modular component, wherein the first mating pocket includes a boundary wall, and wherein a clearance is formed between the first circumferentially extending surface and the boundary wall such that the first thermal barrier coating does not contact the second thermal barrier coating.

2. The modular assembly of claim 1 further comprising a third modular component including a second mating pocket, wherein the second circumferentially extending surface is received within the second pocket.

3. The modular assembly of claim 1, wherein the first thermal barrier coating has a first average thickness, and wherein the second thermal barrier coating has a second average thickness different than the first average thickness.

4. The modular assembly of claim 1, wherein the coating pocket extends from a first edge abutting the first circumferentially extending surface to a second edge abutting the second circumferentially extending surface, and wherein the coating pocket includes:

a circumferentially extending pocket surface extending a majority of a radial length of the second modular component;

a first circumferentially extending transition surface connecting the pocket surface to the first edge; and a second circumferentially extending transition surface connecting the pocket surface to the second edge.

5. A modular assembly for a gas turbine engine, the modular assembly comprising:

a first modular component including a first mating pocket; and a second modular component including:

a first circumferentially extending surface at a first distal end of the second modular component and received within the first mating pocket;

a second circumferentially extending surface at a second, opposing distal end of the second modular component;

a coating pocket extending, in a radial direction, from the first circumferentially extending surface to the second circumferentially extending surface, the coating pocket being recessed towards an interior of the second modular component with respect to first circumferentially extending surface and the second circumferentially extending surface; and a first thermal barrier coating included within the coating pocket and not included on the first circumferentially extending surface or the second circumferentially extending surface, wherein the coating pocket extends from a first edge abutting the first circumferentially extending surface to a second edge abutting the second circumferentially extending surface, and wherein the coating pocket includes:

a circumferentially extending pocket surface extending a majority of a radial length of the second modular component;

a first circumferentially extending transition surface connecting the pocket surface to the first edge; and a second circumferentially extending transition surface connecting the pocket surface to the second edge, wherein the first circumferentially extending transition surface and the second circumferentially extending transition surface are filleted surfaces.

6. A modular vane assembly for a gas turbine engine, the vane assembly comprising:

an inner platform including an inner platform pocket and a radially outwardly facing inner platform surface, wherein at least part of the inner platform pocket is recessed, in the radial direction, from the inner platform surface;

an outer platform including an outer platform pocket and a radially inwardly facing outer platform surface, wherein at least part of the outer platform pocket is recessed, in the radial direction, from the outer platform surface;

an airfoil extending between the inner platform and the outer platform, the airfoil including:

a circumferentially extending, inner platform mating surface at a first distal end of the airfoil and received within the inner platform pocket;

a circumferentially extending, outer platform mating surface at an opposing, second distal end of the airfoil and received within the outer platform pocket;

a coating pocket extending, in a radial direction, from the inner platform mating surface to the outer platform mating surface, the coating pocket being recessed towards an interior of the airfoil with respect to inner platform mating surface and the outer platform mating surface; and a first thermal barrier coating included within the coating pocket and not included on the inner platform mating surface or the outer platform mating surface, a second thermal barrier coating applied to the radially outwardly facing inner platform surface of the inner platform, and a third thermal barrier coating applied to the radially inwardly facing outer platform surface of the outer platform, wherein the inner pocket includes a first boundary wall, wherein the outer pocket includes a second boundary wall, wherein a first clearance is formed between the inner platform mating surface and the first boundary wall such that the first thermal barrier coating does not contact the second thermal barrier coating, and wherein a second clearance is formed between the outer platform mating surface and the second boundary wall such that the first thermal barrier coating does not contact the second thermal barrier coating.

7. The modular vane assembly of claim 6, wherein the first thermal barrier coating has a first average thickness, wherein the second thermal barrier coating has a second average thickness, wherein the third thermal barrier coating has a third average thickness, and wherein the first average thickness is different than the second average thickness and the third average thickness.

8. The modular vane assembly of claim 7, wherein the second average thickness is different than the third average thickness.

9. The modular vane assembly of claim 6, wherein the coating pocket extends from a first edge abutting the inner platform mating surface to a second edge abutting the outer platform mating surface, and wherein the coating pocket includes:

a circumferentially extending pocket surface extending a majority of a radial length of the airfoil;

a first circumferentially extending transition surface connecting the pocket surface to the first edge; and a second circumferentially extending transition surface connecting the pocket surface to the second edge.

10. A modular vane assembly for a gas turbine engine, the vane assembly comprising: an inner platform including an inner platform pocket; an outer platform including an outer platform pocket; an airfoil extending between the inner platform and the outer platform, the airfoil including: a circumferentially extending, inner platform mating surface at a first distal end of the airfoil and received within the inner platform pocket; a circumferentially extending, outer platform mating surface at an opposing, second distal end of the airfoil and received within the outer platform pocket; a coating pocket extending, in a radial direction, from the inner platform mating surface to the outer platform mating surface, the coating pocket being recessed towards an interior of the airfoil with respect to inner platform mating surface and the outer platform mating surface; and a first thermal barrier coating included within the coating pocket and not included on the inner platform mating surface or the outer platform mating surface, wherein the coating pocket extends from a first edge abutting the inner platform mating surface to a second edge abutting the outer platform mating surface, and wherein the coating pocket includes:

a circumferentially extending pocket surface extending a majority of a radial length of the airfoil;

a first circumferentially extending transition surface connecting the pocket surface to the first edge; and a second circumferentially extending transition surface connecting the pocket surface to the second edge, wherein the first transition surface and the second transition surface are filleted surfaces.

11. A method of constructing a modular vane assembly for a gas turbine engine, the method comprising:

manufacturing an airfoil, the airfoil including:

a circumferentially extending, first platform mating surface at a first distal end of the airfoil;

a circumferentially extending, second platform mating surface at an opposing, second distal end of the airfoil; and a coating pocket extending, in a radial direction, from the first platform mating surface to the second platform mating surface, the coating pocket being recessed towards an interior of the airfoil with respect to first platform mating surface and the second platform mating surface;

coating the airfoil with a first thermal barrier coating including applying the first thermal barrier coating within the coating pocket and not on the first platform mating surface or the second platform mating surface;

manufacturing a platform including a platform surface and a platform pocket recessed from the platform surface, wherein the platform pocket includes a boundary wall;

coating the platform with a second thermal barrier including applying the second thermal barrier coating to the platform surface and not to the platform pocket; and assembling the modular vane assembly by inserting the first platform mating surface into the platform pocket and fastening the airfoil in place, wherein the assembling includes inserting the first platform mating surface into the platform pocket such that a first clearance is formed between the first platform mating surface and the boundary wall.

12. The method of claim 11, wherein coating the airfoil includes applying the first thermal barrier coating until it has a first average thickness, wherein coating the platform includes applying the second thermal barrier coating until it has a second average thickness, and wherein the first average thickness is different than the second average thickness.

13. The method of claim 11, wherein the coating pocket extends from a first edge abutting the first platform mating surface to a second edge abutting the second platform mating surface, and wherein manufacturing the airfoil includes creating a coating pocket that includes:

a circumferentially extending pocket surface extending a majority of a radial length of the airfoil;

a first circumferentially extending transition surface connecting the pocket surface to the first edge; and a second circumferentially extending transition surface connecting the pocket surface to the second edge.

14. A method of constructing a modular vane assembly for a gas turbine engine, the method comprising:

manufacturing an airfoil, the airfoil including:

a circumferentially extending, first platform mating surface at a first distal end of the airfoil;

a circumferentially extending, second platform mating surface at an opposing, second distal end of the airfoil; and a coating pocket extending, in a radial direction, from the first platform mating surface to the second platform mating surface, the coating pocket being recessed towards an interior of the airfoil with respect to first platform mating surface and the second platform mating surface;

coating the airfoil with a first thermal barrier coating including applying the first thermal barrier coating within the coating pocket and not on the first platform mating surface or the second platform mating surface;

manufacturing a platform including a platform surface and a platform pocket recessed from the platform surface;

coating the platform with a second thermal barrier including applying the second thermal barrier coating to the platform surface and not to the platform pocket; and assembling the modular vane assembly by inserting the first platform mating surface into the platform pocket and fastening the airfoil in place, wherein the coating pocket extends from a first edge abutting the first platform mating surface to a second edge abutting the second platform mating surface, and wherein manufacturing the airfoil includes creating a coating pocket that includes:

a circumferentially extending pocket surface extending a majority of a radial length of the airfoil;

a first circumferentially extending transition surface connecting the pocket surface to the first edge; and a second circumferentially extending transition surface connecting the pocket surface to the second edge, wherein the first transition surface and the second transition surface are filleted surfaces.

15. The method of claim 11, wherein fastening the airfoil in place includes using a threaded fastener to fasten the airfoil in place.

* * * * *